US008298038B2

(12) United States Patent
O'Connor et al.

(10) Patent No.: US 8,298,038 B2
(45) Date of Patent: Oct. 30, 2012

(54) TOY

(75) Inventors: Stacy Lynn O'Connor, Long Beach, CA (US); Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 272 days.

(21) Appl. No.: 12/766,797

(22) Filed: Apr. 23, 2010

(65) Prior Publication Data

US 2010/0273390 A1 Oct. 28, 2010

Related U.S. Application Data

(60) Provisional application No. 61/173,102, filed on Apr. 27, 2009.

(51) Int. Cl.
*A63H 29/00* (2006.01)
*A63H 18/00* (2006.01)
*A63H 18/14* (2006.01)

(52) U.S. Cl. ..... 446/444; 446/429

(58) Field of Classification Search ..... 446/71, 446/72, 73, 78, 423, 429, 430, 431, 444, 446/445, 446, 447, 476, 478
See application file for complete search history.

(56) References Cited

U.S. PATENT DOCUMENTS

| | | | |
|---|---|---|---|
| 1,538,341 | A | 5/1925 | Lancaster et al. |
| 1,627,959 | A | 5/1927 | Keppel |
| 2,036,802 | A | 4/1936 | Fleishman et al. |
| 2,050,892 | A | 8/1936 | Marx |
| 2,522,160 | A | 9/1950 | Borchers |
| 2,590,508 | A | 3/1952 | Carver et al. |
| 2,776,522 | A | 1/1957 | Schramm et al. |
| 2,817,924 | A | 12/1957 | Schrader |
| 3,281,985 | A | 11/1966 | Alfred |
| D208,096 | S | 7/1967 | Ostrander |

(Continued)

FOREIGN PATENT DOCUMENTS

DE 3215214 A1 11/1983

(Continued)

OTHER PUBLICATIONS

International Search Report for International Application No. PCT/US2010/032305 mailed Feb. 9, 2011.

(Continued)

*Primary Examiner* — Nini Legesse
(74) *Attorney, Agent, or Firm* — Cantor Colburn LLP

(57) ABSTRACT

A reconfigurable structure for use with toy vehicles is provided, the structure having a first tower structure having a plurality of floors each having an entrance and an exit; a lift movably secured to the first tower, the lift being positionable at any entrance of the plurality of floors of the first tower; a ramp movably secured to the first tower, the ramp being positionable at any exit of the plurality of floors of the first tower; a second tower structure having a plurality of floors each having an entrance and an exit; a lift movably secured to the second tower, the lift being positionable at any entrance of the plurality of floors of the second tower; a ramp movably secured to the second tower, the ramp being positionable at any exit of the plurality of floors of the second tower; and wherein the reconfigurable structure is capable of having a stowed configuration and a deployed configuration and the first tower has a connecting member configured to engage the second tower when the reconfigurable structure is in the stowed configuration.

20 Claims, 3 Drawing Sheets

U.S. PATENT DOCUMENTS

| | | | | |
|---|---|---|---|---|
| 3,457,668 | A | 7/1969 | Genin | |
| 3,483,653 | A | 12/1969 | Genin | |
| 3,593,454 | A | 7/1971 | Einfalt | |
| 3,613,908 | A | 10/1971 | Mulitz | |
| 3,653,146 | A | 4/1972 | Goldfarb | |
| 3,694,953 | A | 10/1972 | Tomiyama | |
| D225,166 | S | 11/1972 | Spengler | |
| 3,789,538 | A * | 2/1974 | Spengler et al. | 446/409 |
| D233,457 | S | 10/1974 | Stubbmann | |
| D233,618 | S | 11/1974 | Smith | |
| 3,883,987 | A | 5/1975 | Josh et al. | |
| 3,908,989 | A | 9/1975 | Meyer | |
| 3,949,516 | A | 4/1976 | Gronert | |
| 4,051,624 | A | 10/1977 | Ogawa | |
| 4,068,402 | A | 1/1978 | Tanaka | |
| 4,109,410 | A | 8/1978 | Saitoh | |
| 4,112,610 | A | 9/1978 | Sano | |
| D251,813 | S | 5/1979 | Okado | |
| 4,161,081 | A | 7/1979 | Katzman et al. | |
| 4,227,337 | A | 10/1980 | Murray et al. | |
| 4,251,949 | A | 2/1981 | Buck et al. | |
| 4,349,983 | A | 9/1982 | Kilroy et al. | |
| D269,360 | S | 6/1983 | Ng | |
| 4,458,440 | A | 7/1984 | D'Andrade et al. | |
| 4,582,500 | A | 4/1986 | Hanson et al. | |
| 4,669,657 | A | 6/1987 | Crain et al. | |
| D294,156 | S | 2/1988 | McElhaney | |
| 4,734,076 | A | 3/1988 | Goldstein et al. | |
| 4,767,375 | A | 8/1988 | Fassman | |
| D321,218 | S | 10/1991 | Rylands | |
| 5,078,094 | A | 1/1992 | Hoover | |
| D359,527 | S | 6/1995 | Svindt | |
| D361,606 | S | 8/1995 | Shiraishi | |
| 5,441,435 | A | 8/1995 | Shiraishi | |
| D366,290 | S | 1/1996 | Dieudonne | |
| 5,564,962 | A | 10/1996 | Navarrete Espinosa | |
| 5,653,171 | A | 8/1997 | LeBron et al. | |
| D394,476 | S | 5/1998 | Blumenthal | |
| 5,899,789 | A * | 5/1999 | Rehkemper et al. | 446/444 |
| D442,648 | S | 5/2001 | Ohkado et al. | |
| 6,241,573 | B1 | 6/2001 | Ostendorff et al. | |
| D450,357 | S | 11/2001 | Yamazaki | |
| 6,402,583 | B2 | 6/2002 | Yoneda et al. | |
| 6,406,350 | B2 | 6/2002 | Yoneda et al. | |
| 6,478,654 | B1 | 11/2002 | Rehkemper et al. | |
| 6,508,179 | B2 * | 1/2003 | Annis et al. | 104/60 |
| 6,641,351 | B2 | 11/2003 | Payne | |
| 6,663,464 | B2 | 12/2003 | Payne et al. | |
| D554,203 | S | 10/2007 | Knight et al. | |
| D555,210 | S | 11/2007 | Knight et al. | |
| D555,211 | S | 11/2007 | Knight et al. | |
| 7,614,931 | B2 * | 11/2009 | Nuttall | 446/444 |
| 7,794,301 | B2 * | 9/2010 | Ostendorff et al. | 446/429 |
| 2001/0012745 | A1 | 8/2001 | Yoneda et al. | |
| 2001/0012746 | A1 | 8/2001 | Yoneda et al. | |
| 2003/0224696 | A1 | 12/2003 | Sheltman | |
| 2007/0293122 | A1 | 12/2007 | O'Connor et al. | |
| 2008/0070474 | A1 | 3/2008 | Nuttall | |
| 2009/0072481 | A1 | 3/2009 | Ostendorff | |

FOREIGN PATENT DOCUMENTS

| | | | |
|---|---|---|---|
| GB | 2165022 | A | 4/1986 |
| JP | 2001293259 | A | 10/2001 |
| JP | 2002360945 | A | 12/2002 |
| JP | 2003334390 | A | 11/2003 |
| WO | 99/49948 | A1 | 10/1999 |

OTHER PUBLICATIONS

Written Opinion of the International Searching Authority for International Application No. PCT/US2010/032305 mailed Feb. 9, 2011.

* cited by examiner

TOY

CROSS REFERENCE TO RELATED APPLICATION

This application claims the benefit of United States Provisional Patent Application Ser. No. 61/173,102 filed Apr. 27, 2009, the contents of which is incorporated herein by reference thereto.

BACKGROUND

Various embodiments of the present invention are related to toys in particular, a reconfigurable structure for toy vehicle racing and storage.

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, it is desirable to add track amusement features to the track sets.

Accordingly, it is desirable to provide a toy track set with interchangeable elements to provide numerous configurations.

SUMMARY OF THE INVENTION

In one embodiment, a reconfigurable structure for use with toy vehicles is provided, the structure having a first tower structure having a plurality of floors each having an entrance and an exit; a lift movably secured to the first tower, the lift being positionable at any entrance of the plurality of floors of the first tower; a ramp movably secured to the first tower, the ramp being positionable at any exit of the plurality of floors of the first tower; a second tower structure having a plurality of floors each having an entrance and an exit; a lift movably secured to the second tower, the lift being positionable at any entrance of the plurality of floors of the second tower; a ramp movably secured to the second tower, the ramp being positionable at any exit of the plurality of floors of the second tower; and wherein the reconfigurable structure is capable of having a stowed configuration and a deployed configuration and the first tower has a connecting member configured to engage the second tower when the reconfigurable structure is in the stowed configuration.

In another exemplary embodiment a method providing a reconfigurable structure for use with toy vehicles is provided. The method having the steps of: slidably securing a lift to a first tower structure having a plurality of floors each having an entrance and an exit, the lift being positionable at any entrance of the plurality of floors of the first tower; slidably securing a ramp to the first tower, the ramp being positionable at any exit of the plurality of floors of the first tower; slidably securing a lift to a second tower structure having a plurality of floors each having an entrance and an exit, the of the second tower being positionable at any entrance of the plurality of floors of the second tower; slidably securing a ramp to the second tower, the ramp being positionable at any exit of the plurality of floors of the second tower; and wherein the reconfigurable structure is capable of having a stowed configuration and a deployed configuration and the first tower has a connecting member configured to engage the second tower when the reconfigurable structure is in the stowed configuration.

DETAILED DESCRIPTION

Figure 1:
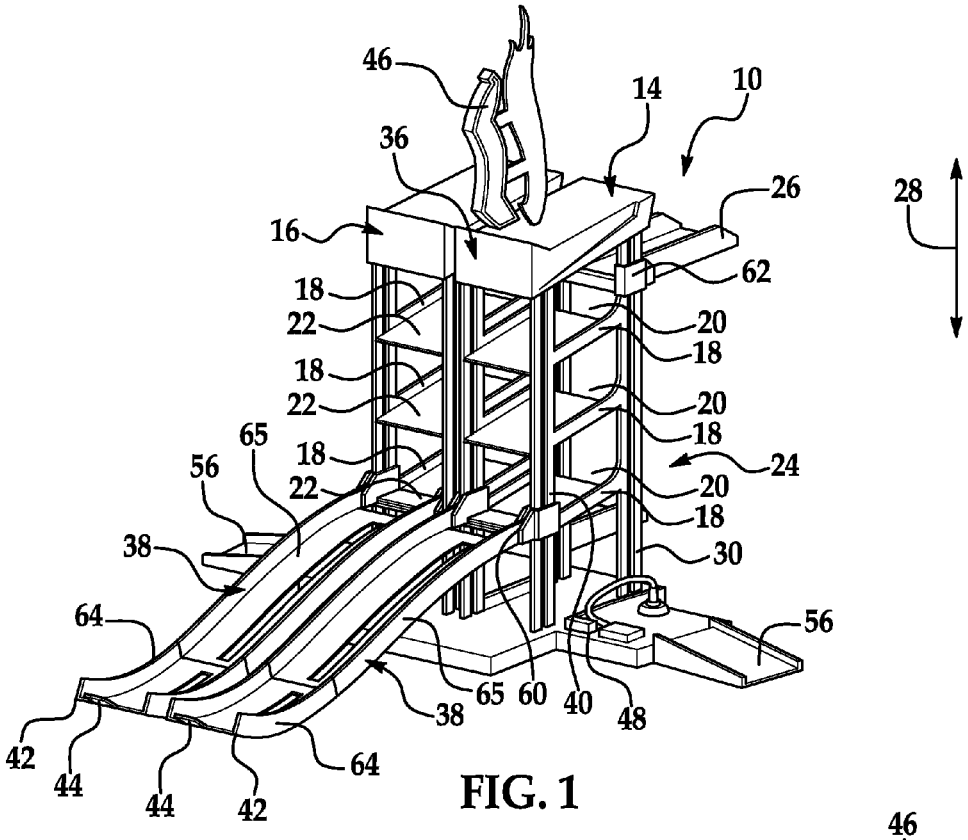
FIG. 1 is a perspective view of a reconfigurable structure in accordance with an exemplary embodiment of the present invention.

In accordance with various embodiments of the present invention a reconfigurable structure 10 for use with a customizable track set is illustrated in FIGS. 1-5B. In one embodiment, the reconfigurable structure is configured for use with toy vehicles 12 or any other object capable of travelling along the track of the track set. As illustrated in the attached FIGS. and appendix the reconfigurable structure has a first tower structure 14 and a second tower structure 16. The first tower structure and the second tower structure each have a plurality of floors 18 each having an entrance 20 and an exit 22. In one embodiment, the towers 14 and 16 are configured to resemble parking structures with a plurality of floors for receipt of toy cars therein.

On an entrance side 24 of first tower structure 14 a lift or ramp 26 is movably secured to the first tower structure such that the lift may move up and down in the directions of arrow 28, the lift being positionable at any entrance of the plurality of floors of the first tower. In addition and in one non-limiting embodiment, the lifts 26 are also pivotally secured to the towers or a respective guide via pins or any other equivalent pivotal securing means to allow the lift to move between a stowed and a deployed position in the direction of arrows 73 illustrated in FIG. 4. See also for example, the lift 26 of tower 16 shown in the stowed position illustrated in FIGS. 5A and 5B while the lift of tower 14 is shown in the deployed position. Thus, the lift may be moved back and forth in the direction of arrows 73 shown in FIG. 4. Alternatively, the lift may be secured to the movable guide 62 in only the deployed position. In one embodiment and in order to allow lift 26 to move up and down in the directions of arrow 28, a feature or portion of the lift slides in a pair of slots or openings 30 formed in first tower structure 14. Lift 26 could also have a feature allowing it to be secured to a flexible track segment 32 via a tongue member 34 secured to the flexible track segment. In addition and similar to the configuration illustrated in FIGS. 5A and 5B, lift 26 could also have a feature allowing it to be secured to a distal end of an exit ramp of a second tower structure. Thus, allowing the two towers to be interconnected via exit ramp 38.

At an exit side 36 of the first tower structure an exit ramp 38 is movably secured to the first tower structure such that the exit ramp may move up and down in the directions of arrow 28, the exit ramp being positionable at any exit of the plurality of floors of the first tower such that toy cars exiting one of the floors may traverse down the exit ramp. In one embodiment and in order to allow the exit ramp to move up and down in the directions of arrow 28, a feature or portion of the exit ramp slides in a pair of slots or openings 40 formed in first tower structure 14. In addition or as an alternative embodiment, the exit ramp is pivotally secured to the tower structure. A distal end 42 of the exit ramp has a feature 44 allowing it to be secured to a flexible track segment (not shown) or a lift of another tower. Thus, tower structure 14 may be secured to track segments at both the lift and the exit ramp. Alternatively, the track segment can be formed without feature 44.

Mounted to the top of first tower structure 14 or alternatively second tower structure 16 is a connecting member 46. Connecting member 46 is pivotally secured to the tower structure at one end and has a feature at another end that allows the same to engage or secure the tower structures together when they are in the stowed position illustrated in FIG. 4. In addition and in one alternative embodiment, a base portion 48 of tower structure 14 has features 50 to engage complimentary features 52 of a base portion 54 of tower structure 16 when they are in the stowed position. One non-limiting arrangement is a tongue 50 and recess configuration 52 illustrated in FIGS. 5A and 5B. In addition and to provide for additional play each base portion 48, 54 may further comprise a ramp portion 56 and a toy vehicle can be placed on a surface of the base portion proximate to the ramp portion. In still yet another alternative embodiment, one or more of the base portions may comprise a moveable turntable 58 that allows a vehicle placed thereon to be rotated providing further configurations for enhanced play.

In still another embodiment, the exit ramp 38 is pivotally mounted to a guide 60 via pins or any other equivalent means, and guide 60 slides up and down on the exit side of the first tower structure. In similar fashion and in one embodiment, the lift is also pivotally secured to a guide 62 that slides up and down on the entrance side of the first tower structure. The lift may also be configured to engage flexible track segment 32 or the end of the exit ramp of another tower. In still another alternative embodiment, the exit ramp comprises an end track portion 64 pivotally secured an upper track portion 65 of the exit ramp (via pins or any other equivalent means) to allow for various configurations including the folded or stowed configuration illustrated in FIG. 4. Here upper track portion 65 is also pivotally secured to the tower via guide 60 or any other equivalent structure.

To provide for additional play configurations, the second tower structure of the reconfigurable structure is similar to the first tower structure in that it also has a plurality of floors 18 each having an entrance 20 and an exit 22. Similar to the first tower structure, the entrance side 24 of the second tower structure has a lift or ramp 26 that is movably secured to the same such that the lift may move up and down in the directions of arrows 28, the lift being positionable at any entrance of the plurality of floors of the second tower structure. Similar to the first tower structure and in order to allow lift 26 to move up and down in the directions of arrow 28, a feature or portion of the lift slides in a pair of slots or openings 30 formed in second tower structure. Again and similar to the first tower structure, the lift 26 could also have a feature allowing it to be secured to a flexible track segment 32 via a tongue member 34 secured to the flexible track segment. In addition, the lift may also be secured to an end of an exit ramp of another tower structure such as the first tower structure.

At an exit side 36 of the second tower structure an exit ramp 38 is also movably secured to the first tower structure such that the exit ramp may move up and down in the directions of arrows 28. Again, the exit ramp is positionable at any exit of the plurality of floors of the second tower such that toy cars exiting one of the floors may traverse down the exit ramp. In one embodiment and in order to allow the exit ramp to move up and down in the directions of arrow 28, a feature or portion of the exit ramp slides in a pair of slots or openings 40 formed in the second tower structure. A distal end 42 of the exit ramp has a feature 44 allowing it to be secured to a flexible track segment (not shown) or a lift of another tower structure. Thus, tower structure 16 may be secured to track segments and/or other tower structures at both the lift and/or the exit ramp. Alternatively, the track segment can be formed without feature 44.

In still another embodiment, the exit ramp 38 is pivotally mounted to a guide 60 that slides up and down on the exit side of the first tower structure. Similarly, the lift may also be movably or pivotally secured to a guide 62 that slides up and down on the entrance side of the first tower structure. As discussed herein, the lift is configured to engage a flexible track segment 32 or an exit ramp of another tower structure. In still another alternative embodiment, an end track portion 64 of the exit ramp is pivotally secured to the same to allow for various configurations including the folded or stowed configuration illustrated in FIG. 4.

Figure 3:
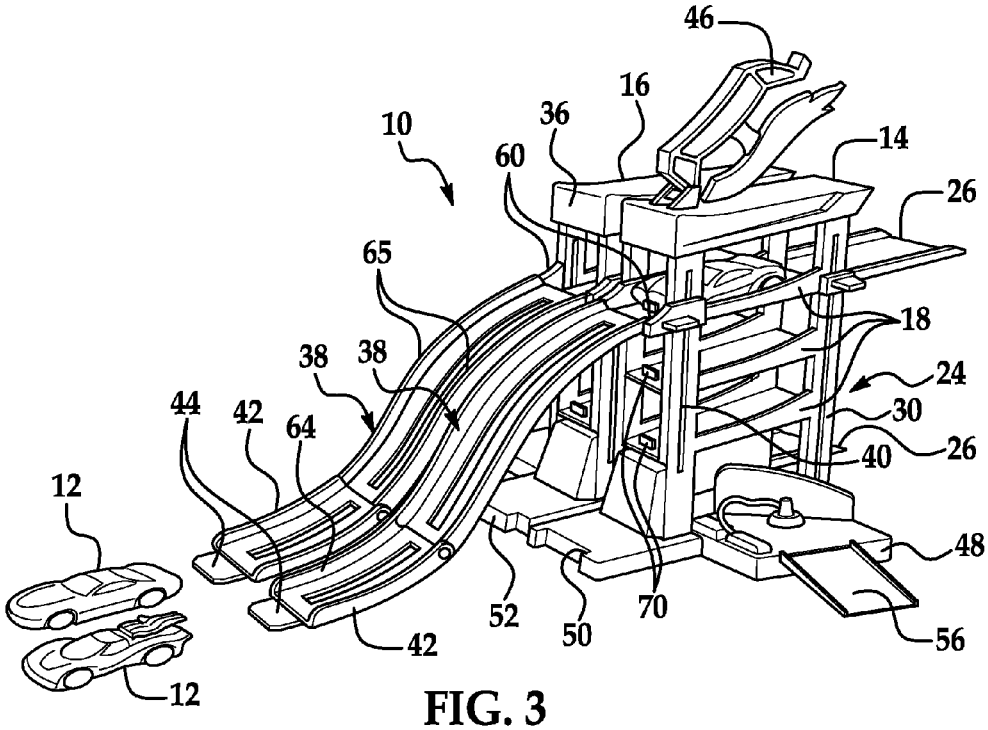
FIG. 3 is a perspective view of the reconfigurable structure of FIG. 1 in another deployed configuration.

In accordance with exemplary embodiments of the present invention, the reconfigurable structure is positionable in various configurations for use with toy vehicles for example; one non-limiting configuration is illustrated in FIGS. 1 and 3 wherein side by side gravity racing is provided by allowing the cars to exit a floor via the exit ramp. In one alternative embodiment, the exits 22 of each floor may be provided with a movable stop or release 70 (illustrated in FIG. 3 as well as FIGS. 5A and 5B) such that each car may be simultaneously released down the exit ramp. The moveable stop can be depressed by movement of a button or connector attached to the side of the tower structure by a user's hand. See for example FIGS. 5A and 5B.

Figure 2:
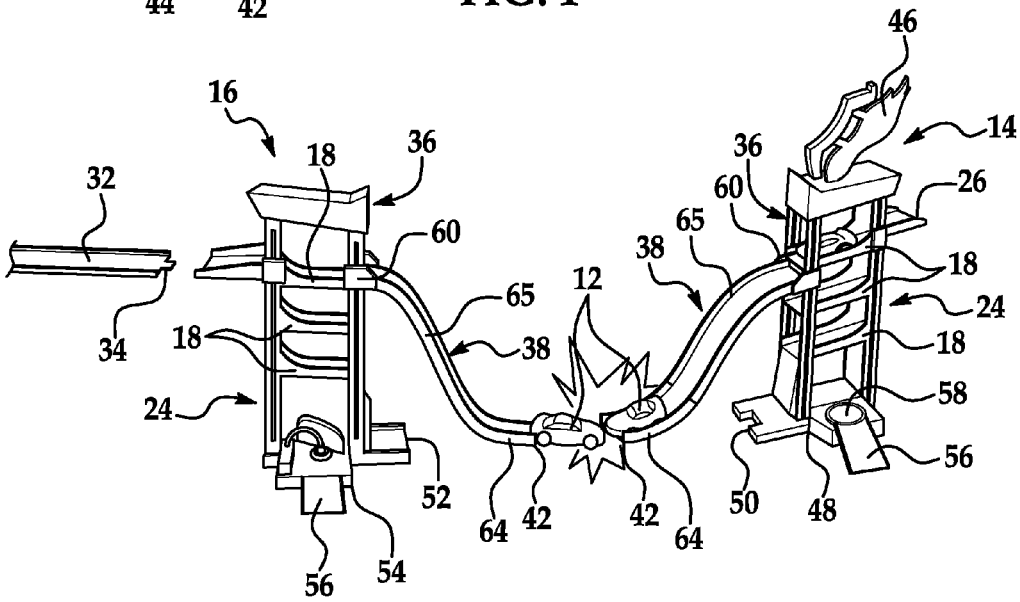
FIG. 2 is a perspective view of the reconfigurable structure of FIG. 1 in a deployed configuration.
Figure 4:
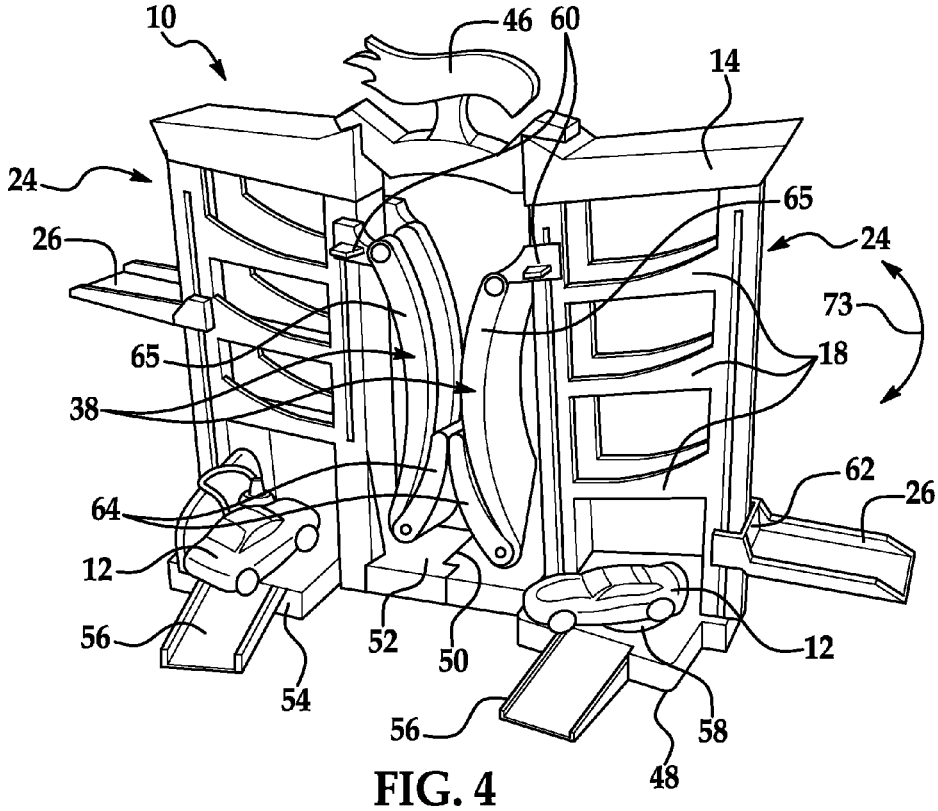
FIG. 4 is a perspective view of the reconfigurable structure of FIG. 1 in a stowed configuration.

In still another exemplary embodiment and as illustrated in FIG. 2 the tower structures may be positioned such that the exit ramps will cause the toy vehicles to crash into each other. FIG. 4 shows another configuration wherein the towers of the reconfigurable structure are positioned in a stowed position wherein the exit ramps are folded or pivoted into a non-use position and the connecting member secures the two towers together.

In still another alternative configuration, the exit ramp of one tower is coupled to an entrance of a floor of another tower or the movable lift of the other tower such that the exit ramp may be slid up and down in the direction of arrow 28 and lift may be slid up and down in the direction of arrow 28 and the ramp/lift arrangement allows a car from one floor of a first tower to travel to another floor of a second tower wherein the floors are at different levels and can be easily slid up and down via the movable lift 26 pivotally secured to guide 62 and the movable exit ramp pivotally secured to a guide 60 that slides up and down in the direction of arrows 28.

Figure 5A:
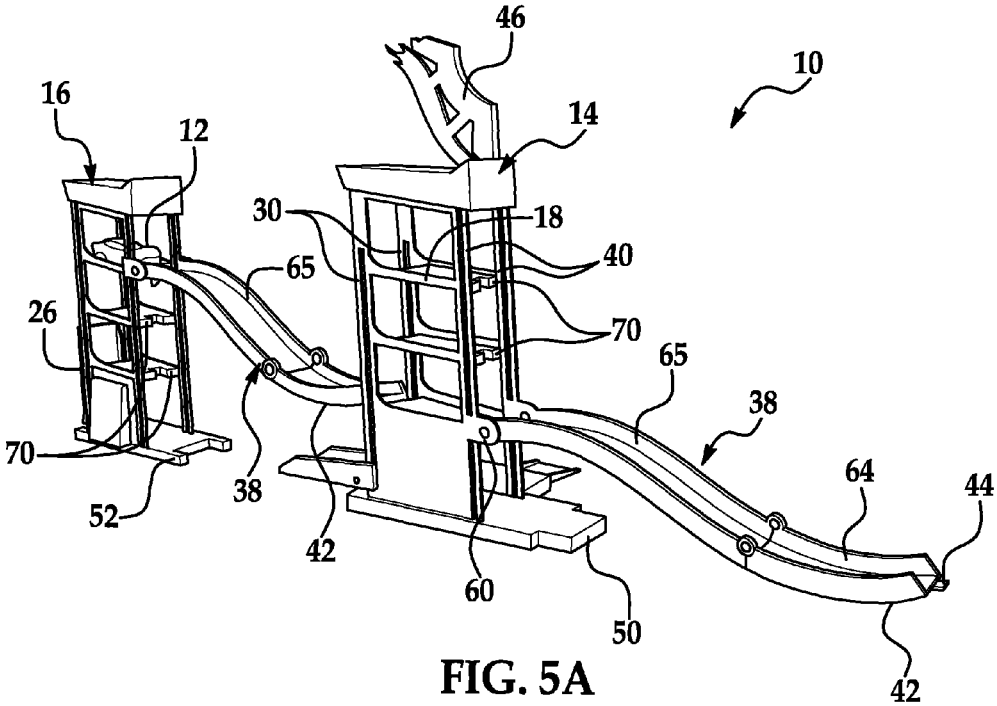
FIGS. 5A and 5B illustrate a perspective view of the reconfigurable structure of FIG. 1 in another deployed configuration.
Figure 5B:
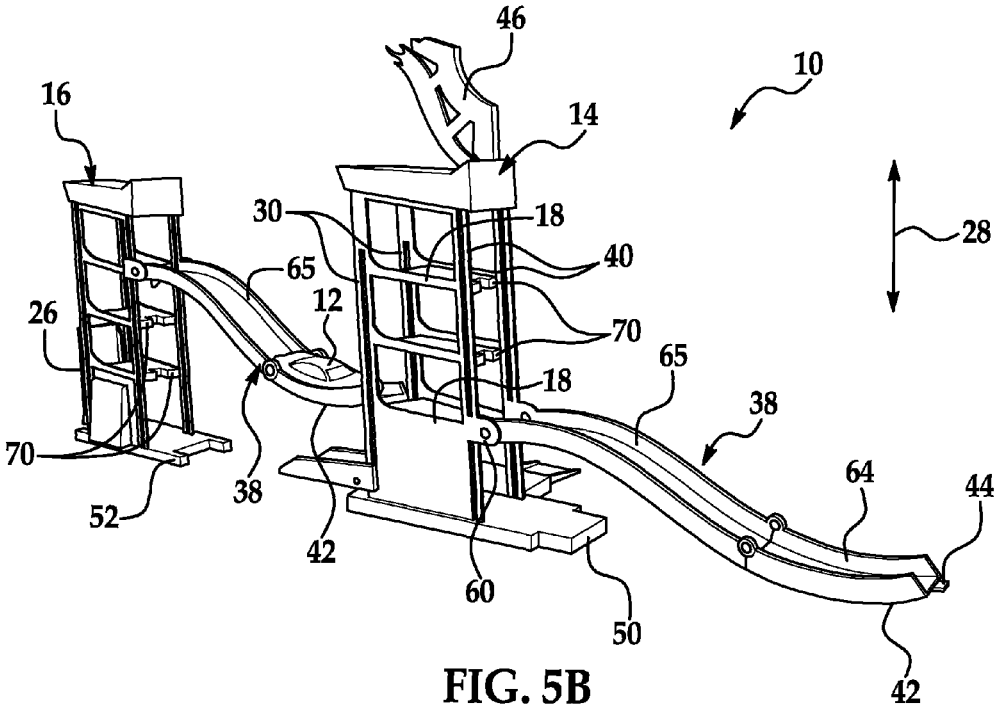

Referring to FIGS. 5A and 5B another deployed configuration of at least two tower segments is illustrated. Here an exit ramp 38 of tower 16 has its distal end coupled to another floor 18 of tower 14 such that a toy car or other movable object 12 is released when a user depresses a portion of movable stop 70 (FIG. 5A) disposed at a side of tower 16 such that downward movement of the movable stop is effectuated and the car begins to roll down the track as illustrated in FIG. 5B. Although, exit ramp 38 is shown coupled to an entrance of a floor 18 it is also understood that exit ramp 38 can be releaseably coupled to lift 26 by for example, tongue 44 that engages features of lift 26. It being understood that each end ramp 38 is slidably and pivotally secured to a respective tower for example, guide 60 of tower 16 and lift 26 and guide 62 of tower 14 thus, each end may move up and down in the directions of arrows 28 and the pivotal securement of the lift and ramp allows interconnection of the two tower structures. Thus, various levels or floors or each tower can be connected and then un-connected for multiple configurations. For example, level 3 of tower 16 can be coupled to level 1 of tower 14 via lift 26 of tower 14 or exit ramp 38 can be directly coupled to the entrance of level 1 of tower 14.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A reconfigurable structure for use with toy vehicles, comprising:

a first tower structure having a plurality of floors each having an entrance and an exit;

a lift movably secured to the first tower, the lift being positionable at any entrance of the plurality of floors of the first tower;

a ramp movably secured to the first tower, the ramp being positionable at any exit of the plurality of floors of the first tower;

a second tower structure having a plurality of floors each having an entrance and an exit;

a lift movably secured to the second tower, the lift being positionable at any entrance of the plurality of floors of the second tower;

a ramp movably secured to the first tower, the ramp being positionable at any exit of the plurality of floors of the second tower; and wherein the reconfigurable structure is capable of having a stowed configuration and a deployed configuration and the first tower has a connecting member configured to engage the second tower when the reconfigurable structure is in the stowed configuration.

2. The reconfigurable structure as in claim 1, wherein the ramps each have an end portion pivotally mounted to another portion of the ramp.

3. The reconfigurable structure as in claim 1, wherein the connecting member is pivotally mounted to the first tower.

4. The reconfigurable structure as in claim 1, wherein the first tower structure is completely separable from the second tower structure.

5. The reconfigurable structure as in claim 1, wherein the ramp of the first tower structure is movably secured to a pair of slots disposed in the first tower structure and the ramp of the second tower structure is movably secured to a pair of slots disposed in the second tower structure.

6. The reconfigurable structure as in claim 5, wherein the ramps each have an end portion pivotally mounted to another portion of the ramp.

7. The reconfigurable structure as in claim 6, wherein the first tower structure is completely separable from the second tower structure.

8. The reconfigurable structure as in claim 1, wherein the lift of the first tower structure is movably secured to a pair of slots disposed in the first tower structure and the lift of the second tower structure is movably secured to a pair of slots disposed in the second tower structure.

9. The reconfigurable structure as in claim 8, wherein the ramp of the first tower structure is movably secured to a pair of slots disposed in the first tower structure and the ramp of the second tower structure is movably secured to a pair of slots disposed in the second tower structure.

10. The reconfigurable structure as in claim 9, wherein the ramps each have an end portion pivotally mounted to another portion of the ramp.

11. The reconfigurable structure as in claim 10, wherein the first tower structure is completely separable from the second tower structure.

12. The reconfigurable structure as in claim 1, wherein the lift of the first tower structure is pivotally secured to guide slidably received within a pair of slots disposed in the first tower structure and the exit ramp of the second tower structure is pivotally secured to a guide slidably received within a pair of slots disposed in the second tower structure and the exit ramp of the second tower has a feature disposed at a distal end configured to be received and engaged by the lift of the first tower structure.

13. The reconfigurable structure as in claim 12, wherein the first tower structure is completely separable from the second tower structure.

14. A method of providing a reconfigurable structure for use with toy vehicles, the method comprising:

slidably securing a lift to a first tower structure having a plurality of floors each having an entrance and an exit, the lift being positionable at any entrance of the plurality of floors of the first tower;

slidably securing a ramp to the first tower, the ramp being positionable at any exit of the plurality of floors of the first tower;

slidably securing a lift to a second tower structure having a plurality of floors each having an entrance and an exit, the of the second tower being positionable at any entrance of the plurality of floors of the second tower;

slidably securing a ramp to the second tower, the ramp being positionable at any exit of the plurality of floors of the second tower; and wherein the reconfigurable structure is capable of having a stowed configuration and a deployed configuration and the first tower has a connecting member configured to engage the second tower when the reconfigurable structure is in the stowed configuration.

15. The method as in claim 14, wherein the ramps each have an end portion pivotally mounted to another portion of the ramp and wherein the connecting member is pivotally mounted to the first tower.

16. The method as in claim 15, wherein the first tower structure is completely separable from the second tower structure and wherein the ramp of the first tower structure is movably secured to a pair of slots disposed in the first tower structure and the ramp of the second tower structure is movably secured to a pair of slots disposed in the second tower structure.

17. The method as in claim 16, wherein the ramps each have an end portion pivotally mounted to another portion of the ramp.

18. The method as in claim 14, wherein the lift of the first tower structure is movably secured to a pair of slots disposed in the first tower structure and the lift of the second tower structure is movably secured to a pair of slots disposed in the second tower structure.

19. The method as in claim 18, wherein the ramp of the first tower structure is movably secured to a pair of slots disposed in the first tower structure and the ramp of the second tower structure is movably secured to a pair of slots disposed in the second tower structure.

20. The method as in claim 19, wherein the ramps each have an end portion pivotally mounted to another portion of the ramp.

* * * * *